US010864730B2

(12) United States Patent
Byun et al.

(10) Patent No.: US 10,864,730 B2
(45) Date of Patent: Dec. 15, 2020

(54) ELECTROHYDRODYNAMIC PRINTING APPARATUS

(71) Applicant: ENJET CO. LTD., Suwon-si (KR)

(72) Inventors: Do Young Byun, Seoul (KR); Vu Dat Nguyen, Suwon-si (KR); Kwangsun Jeon, Suwon-si (KR); Yong Hee Jang, Suwon-si (KR)

(73) Assignee: ENJET CO. LTD., Suwon-si (KR)

( * ) Notice: Subject to any disclaimer, the term of this patent is extended or adjusted under 35 U.S.C. 154(b) by 0 days.

(21) Appl. No.: 16/585,980

(22) Filed: Sep. 27, 2019

(65) Prior Publication Data

US 2020/0189280 A1 Jun. 18, 2020

(30) Foreign Application Priority Data

Dec. 13, 2018 (KR) ..... 10-2018-0160716

(51) Int. Cl.
*B41J 2/14* (2006.01)

(52) U.S. Cl.
CPC ..... *B41J 2/14314* (2013.01)

(58) Field of Classification Search
CPC . B41J 2/14314; B41J 2/06; B41J 2/045; B41J 11/002; B41J 29/00; B41J 3/4073; B29C 64/112; B29C 64/268; B33Y 30/00
See application file for complete search history.

(56) References Cited

U.S. PATENT DOCUMENTS

2011/0187798 A1* 8/2011 Rogers ..... B41J 2/09 347/55

FOREIGN PATENT DOCUMENTS

| | | | |
|---|---|---|---|
| JP | 2006-297754 | A | 11/2006 |
| JP | 2007-038634 | A | 2/2007 |
| KR | 10-0631181 | B1 | 10/2006 |
| KR | 10-0766300 | B1 | 10/2007 |
| KR | 10-0825015 | B1 | 4/2008 |
| KR | 10-2013-0029249 | A | 3/2013 |
| KR | 10-1275225 | B1 | 6/2013 |
| KR | 10-2016-0013708 | A | 2/2016 |
| KR | 10-1611566 | B1 | 4/2016 |
| KR | 10-2016-0085861 | A | 7/2016 |

OTHER PUBLICATIONS

IP.com search (Year: 2020).*

* cited by examiner

*Primary Examiner* — Lisa Solomon
(74) *Attorney, Agent, or Firm* — Saliwanchik, Lloyd & Eisenschenk

(57) ABSTRACT

Disclosed is an electrohydrodynamic printing apparatus including: a nozzle configured to discharge liquid toward a substrate; a voltage applier configured to form an electric field between the nozzle and the substrate; and a laser beam emitter configured to emit a laser beam toward a position to which liquid is discharged on the substrate.
Thus, it is possible to accurately and stably form a microscale deposition structure.

18 Claims, 9 Drawing Sheets

<PRIOR ART> <PRESENT INVENTION>

<PRIOR ART> <PRESENT INVENTION>

ELECTROHYDRODYNAMIC PRINTING APPARATUS

CROSS-REFERENCE TO RELATED APPLICATION

This application claims priority to Korean Application No. 10-2018-0160716, filed Dec. 13, 2018, which is hereby incorporated by reference in its entirety.

BACKGROUND OF THE INVENTION

(A) Field of the Invention

The disclosure relates to an electrohydrodynamic jet printing apparatus, and more particularly to an electrohydrodynamic printing apparatus capable of stably forming a microscale deposition structure.

(B) Description of the Related Art

An ink jet apparatus for jetting liquid in the form of a droplet was mostly applied to an inkjet printer in the past, but has recently been widely applied to a display, a printed circuit board, a digital network architecture (DNA) chip fabricating process, and the like state-of-the-art industry.

A conventional ink jet apparatus has generally employed a piezoelectric driving method or a thermal driving method to jet ink in the form of a droplet. However, the size of droplet the ink jet apparatus using the piezoelectric driving method or the thermal driving method can reduce is limited due to restricted driving energy. Further, the ink jet apparatus using the thermal driving method may have a problem of material deformation caused by heat.

As an apparatus developed to solve the problems of the conventional ink jet apparatus, an electrohydrodynamic (EHD) printing apparatus employs electrostatic force based on potential difference caused by applying voltage between a nozzle and a substrate to discharge liquid.

Because an EHD printing method discharges liquid based on the electrostatic force of pulling a liquid surface, nanoscale patterning is possible unlike the conventional printing method, and it is possible to not only discharge liquid of high viscosity but also make a uniform droplet.

However, when the surface of the substrate is uneven or made of materials different according to positions, surface energy is varied depending on the positions of the substrate and thus a state of a droplet deposited on the substrate is not maintained even though a microscale droplet is discharged from a nozzle.

Further, when printing is performed on a curved surface or a three-dimensionally stepped structure, natural flow occurs due to capillary flow, etc. at a position of an edge and the like, and thus makes it difficult to actualize precise patterning.

PRIOR ART BIBLIOGRAPHY

Patent Documents (Patent document 1) KR10-1275225 B1

SUMMARY OF THE INVENTION

Accordingly, the disclosure is conceived to solve the foregoing problems, and an aspect of the disclosure is to provide an electrohydrodynamic printing apparatus capable of accurately and stably forming a microscale deposition structure by maintaining a state of a droplet deposited on a substrate.

The problems to be solved by the disclosure are not limited to those mentioned above, and other unmentioned problems will become apparent to a person skilled in the art by the following descriptions.

In accordance with an embodiment of the disclosure, there is provided an electrohydrodynamic printing apparatus including: a nozzle configured to discharge liquid toward a substrate; a voltage applier configured to form an electric field between the nozzle and the substrate; and a laser beam emitter configured to emit a laser beam toward a position to which liquid is discharged on the substrate.

The laser beam emitter may be configured to emit the laser beam in a direction perpendicular to the substrate.

The nozzle may be provided obliquely to the substrate.

The electrohydrodynamic printing apparatus may further include a slit through which the laser beam passes.

The electrohydrodynamic printing apparatus may further include a slit adjuster configured to adjust a size of the slit.

The slit adjuster may include: a pair of first moving plates configured to move in a first axial direction perpendicular to the laser beam and adjust a spaced distance therebetween to adjust a width of the slit in the first axial direction; and a pair of second moving plates configured to move in a second axial direction perpendicular to the laser beam and the first axial direction and adjust a spaced distance therebetween to adjust a width of the slit in the second axial direction.

The first moving plate and the second moving plate may be disposed as spaced apart in an emission direction of the laser beam.

The electrohydrodynamic printing apparatus may further include: a check lamp configured to emit check light to pass through the slit and reach the substrate; and a check camera configured to capture the check light that reaches the substrate.

The laser beam emitter may emit laser beams different in wavelength according to kinds of liquid discharged from the nozzle.

The laser beam may be emitted as a continuous laser.

The laser beam may be emitted as a pulse laser.

A pulse with which the laser beam is emitted may be synchronized with a frequency at which the nozzle discharges the liquid.

The electrohydrodynamic printing apparatus may further include a condensing lens adjacent to the substrate and configured to condense the laser beam.

The electrohydrodynamic printing apparatus may further include a first monitoring camera configured to monitor in real time a process of depositing and hardening the liquid discharged from the nozzle onto the substrate.

The first monitoring camera may be configured to capture an image viewed on the same line as the laser beam.

The electrohydrodynamic printing apparatus may further include a cut filter disposed on an optical path between the first monitoring camera and the substrate and configured to filter out a part of light.

The electrohydrodynamic printing apparatus may further include a second monitoring camera including an optical axis formed obliquely to an optical axis of the first monitoring camera, and configured to capture a larger region than the first monitoring camera The electrohydrodynamic printing apparatus may further include: a nozzle driver configured to move the nozzle in x-axial, y-axial and z-axial directions; and a laser-beam emitter driver configured to move the laser beam emitter in the x-axial, y-axial and z-axial directions.

BRIEF DESCRIPTION OF THE DRAWINGS

The above and/or other aspects of the disclosure will become apparent and more readily appreciated from the following description of the exemplary embodiments, taken in conjunction with the accompanying drawings, in which.

DETAILED DESCRIPTION

Concrete embodiments of the disclosure will be described in detail with reference to the accompanying drawings.

Figure 1:
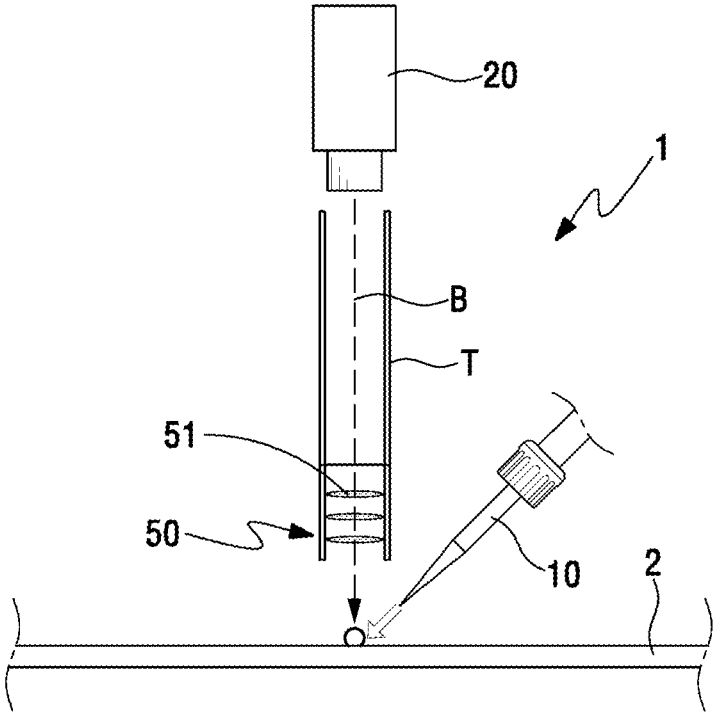
FIGS. 1 and 2 are schematic diagrams of an electrohydrodynamic printing apparatus according to the disclosure.

FIG. 1 illustrates a schematic diagram of an electrohydrodynamic printing apparatus 1 according to the disclosure.

The electrohydrodynamic printing apparatus 1 according to the disclosure roughly includes a nozzle 10, a voltage applier (not shown), and a laser beam emitter 20.

The nozzle 10 discharges liquid toward a substrate 2. To this end, an electrohydrodynamic (EHD) method of using electrostatic force exerted based on potential difference between the nozzle 10 and the substrate 2 to discharge liquid is used, so that the liquid can be precisely discharged to a nanoscale extent, thereby forming a fine deposition structure on the substrate 2. The nozzle 10 includes a detachable tip, so that the size of droplet to be discharged can be adjusted by replacing the tip.

The voltage applier serves to form an electric field between the nozzle 10 and the substrate 2. More specifically, the voltage applier applies high voltage to one of the nozzle 10 and the substrate 2 and grounds the other one so that potential difference can be made between the nozzle 10 and the substrate 2.

The laser beam emitter 20 emits a laser beam B toward a position at which the liquid is discharged on the substrate 2, thereby applying energy to the liquid reaching the substrate 2. The laser beam B is focused within a small radius, and thus emitted to only the position where liquid is discharged on the substrate 2. Between the laser beam emitter 20 and the substrate 2, a tube T is placed to surround the traveling path of the laser beam B. The laser beam B emitted from the laser beam emitter 20 may for example have a diameter of about 3 mm.

By the foregoing EHD printing apparatus 1 of the disclosure, the liquid discharged from the nozzle 10 is heated to be dried and hardened to some extent while passing through the laser beam B emitted onto the substrate 2, and therefore the liquid is not spread, deformed or moved on the substrate 2 but rapidly and completely hardened even on the substrate 2 when reaching the substrate 2, thereby making it possible to form a deposition structure in which the discharged liquid is in an accurate and stable state. In particular, such features are effective for forming a deposition structure with which fine pattern uniformity, high thickness and liquid flow control are important.

Figure 8:
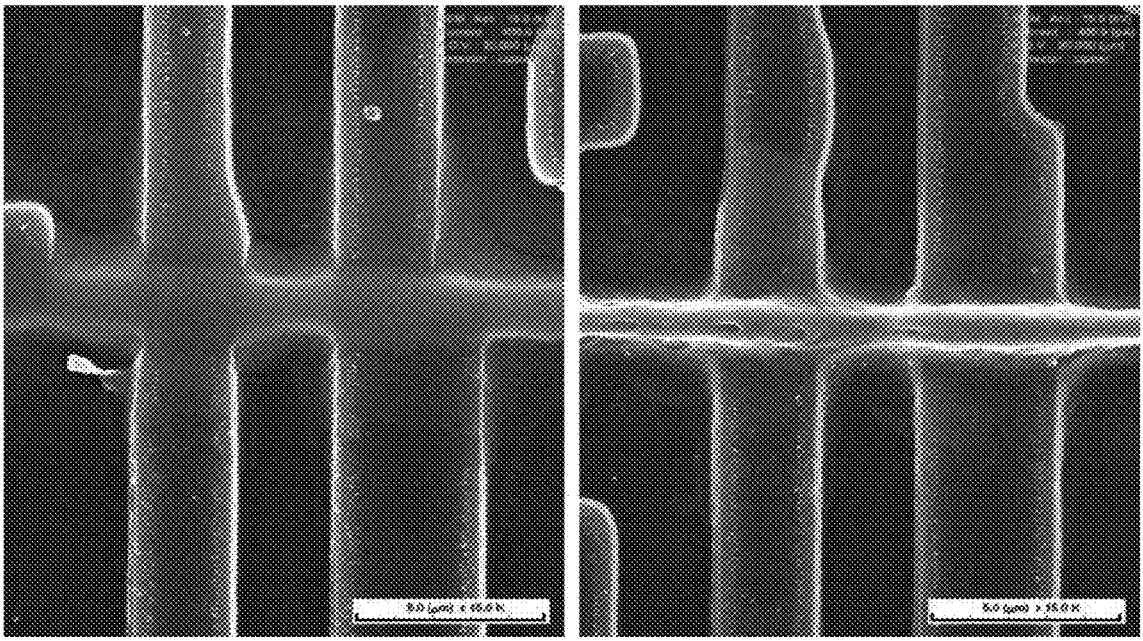
FIGS. 8 and 9 are images showing actual results of deposition structures formed by an electrohydrodynamic printing apparatus according to the disclosure.
Figure 9:
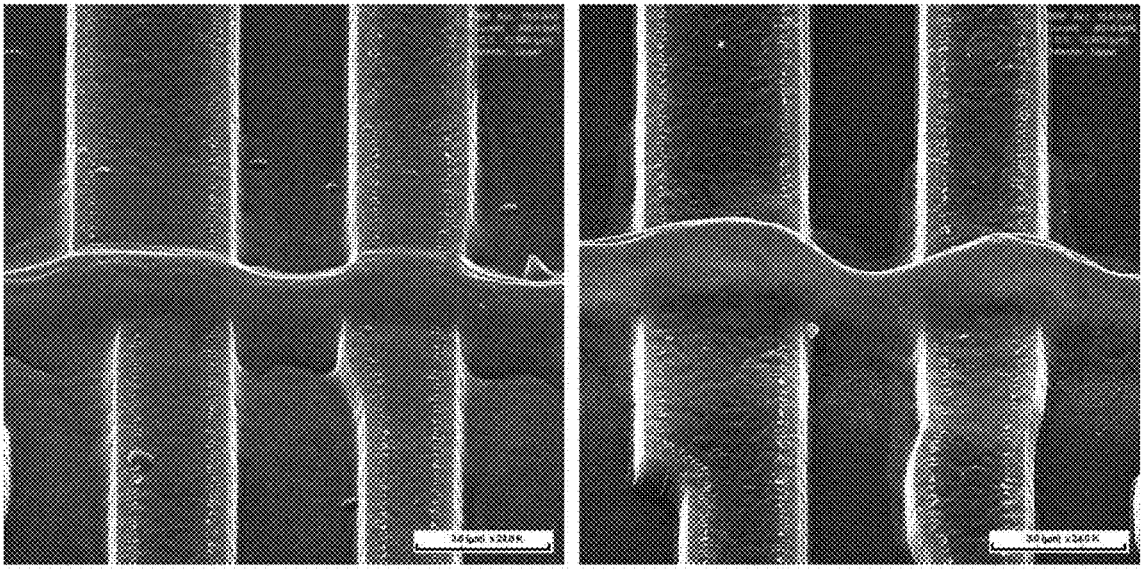

FIGS. 8 and 9 are enlarged image showing actual results of a deposition structure formed by an EHD printing apparatus according to the disclosure and the deposition formed by a conventional EHD printing apparatus. FIG. 8 shows the deposition structures viewed from the top, and FIG. 9 shows the deposition structures obliquely viewed from the top. The conventional deposition structure formed on a substrate having an uneven surface shows that liquid flows on the substrate and therefore a linewidth of the deposition structure increases, and in particular, the liquid spreads a lot in a stepped portion and therefore the linewidth of the deposition structure is largely varied with respect to the stepped portion. On the other hand, the deposition structure formed by the EHD printing apparatus according to the disclosure shows that a linewidth of the deposition structure is almost uniformly and finely maintained, and, even in a stepped portion, liquid hardly spreads and thus the linewidth of the deposition structure is approximately uniform around the stepped portion.

Further, based on the features of the laser beam B concentrated within a small radius, the laser beam B is exactly emitted to only the liquid discharged onto the substrate 2, and thus has less influence on the other portion of the substrate 2.

The laser beam emitter 20 may be configured to emit the laser beam B in a direction perpendicular to the substrate 2.

When the laser beam B is emitted perpendicularly to the substrate 2, the cross-sectional area of the laser beam B on a traveling path is equal to the cross-sectional area of the laser beam B incident to the substrate 2, and it is easy to calculate a position to which the laser beam B will be emitted. Therefore, the laser beam B is accurately and easily emitted to a certain position on the substrate 2.

When the laser beam emitter 20 is configured to emit the laser beam B in the direction perpendicular to the substrate 2, the nozzle 10 may be obliquely provided with respect to the substrate 2.

In this case, it is possible to discharge the liquid at a position to which the laser beam B is incident on the substrate 2 without interference between the path of the laser beam B and the nozzle 10, thereby inhibiting the nozzle 10 from being clogged as the liquid is hardened at a nozzle tip by the laser beam B.

Figure 2:
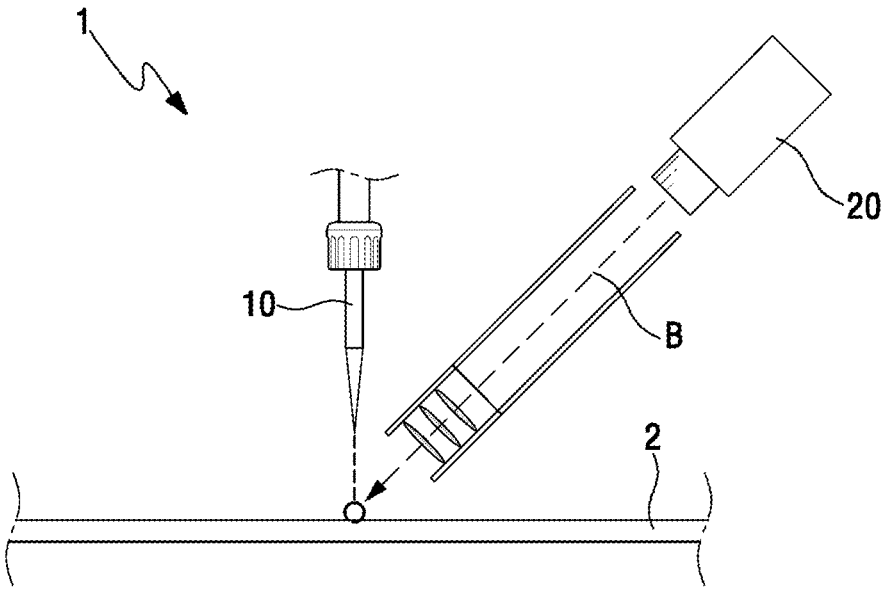

Alternatively, as shown in FIG. 2, the nozzle 10 may discharge the liquid in a direction perpendicularly to the substrate 2, and the laser beam emitter 20 may be obliquely provided with respect to the substrate 2.

In this case, the nozzle 10 not only accurately and easily discharges the liquid to a certain position on the substrate 2, but is also inhibited from being clogged as the liquid is hardened at the nozzle tip by the laser beam B. In addition, the laser beam B is incident to a position to which the liquid is discharged on the substrate 2, thereby inhibiting the liquid from spreading on the substrate 2 and rapidly hardening the liquid.

Figure 3:
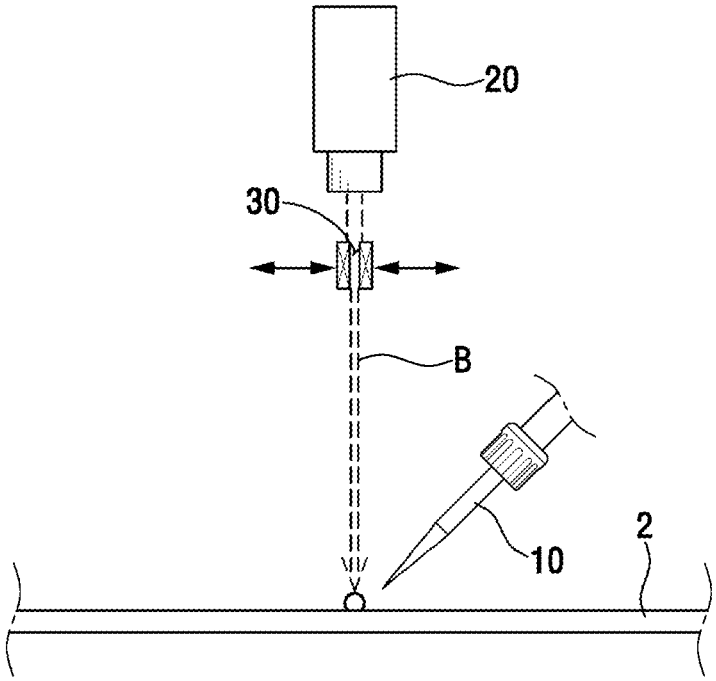
FIG. 3 is a diagram showing a slit of an electrohydrodynamic printing apparatus according to the disclosure.

The EHD printing apparatus 1 according to the disclosure may further include a slit 30 as shown in FIG. 3.

The slit 30 refers to an element through which the laser beam B emitted from the laser beam emitter 20 passes before reaching the substrate 2, and has a very narrow hole.

The slit 30 changes the laser beam B to have the same diameter as a necessary diameter suitable for accurately hardening the liquid discharged on the substrate 2. After passing through the slit 30, the laser beam B having a diameter larger than the necessary diameter is changed into the laser beam B having the necessary diameter.

The size of the slit 30 may be adjusted by a slit adjuster 80.

The size of droplet discharged from the nozzle 10 and the diameter of the laser beam B for hardening the discharged liquid need to be varied depending to the scale of the deposition structure desired to be formed on the substrate 2.

The slit adjuster 80 adjusts the size of the slit 30, so that the cross-sectional area of the laser beam B emitted to the discharged liquid can be adjusted without adjusting the diameter of the laser beam B emitted from the laser beam emitter 20.

For reference, as described above, the size of droplet discharged from the nozzle 10 is adjustable by replacing the tip of the nozzle 10.

Figure 4A:
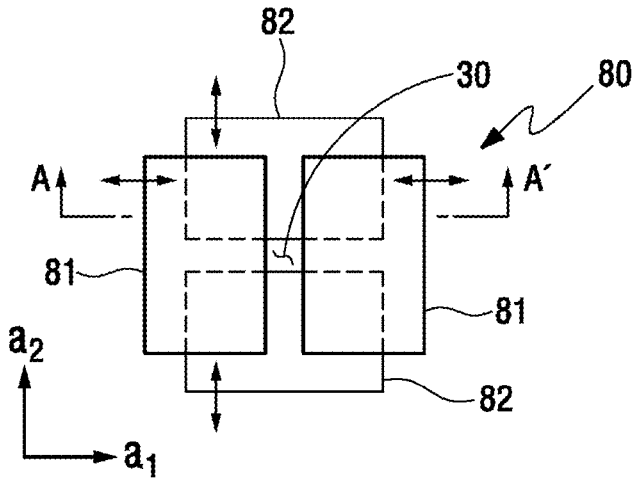
FIGS. 4A and 4B are diagrams showing a slit adjuster of an electrohydrodynamic printing apparatus according to the disclosure.
Figure 4B:
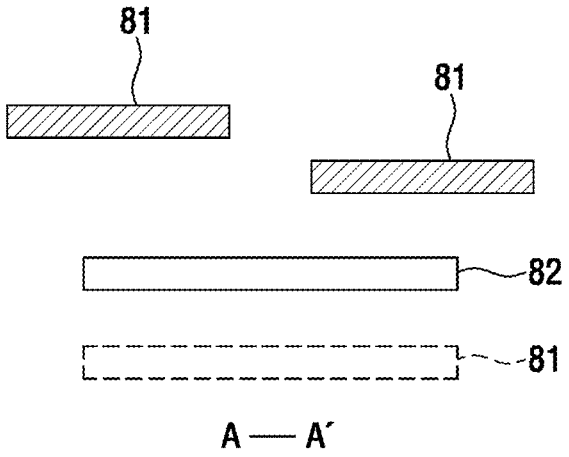

In more detail, the slit adjuster 80 may include a pair of first moving plates 81 and a pair of second moving plates 82 as shown in FIGS. 4A and 4B.

The pair of first moving plates 81 move far away from or close to each other along a first axial direction a1 perpendicular to the laser beam B so that a distance therebetween can be adjusted to thereby adjust the width of the slit 30 in the first axial direction a1, and the pair of second moving plates 82 move far away from or close to each other along a second axial direction a2 perpendicular to the laser beam B and the first axial direction a2 so that a distance therebetween can be adjusted to thereby adjust the width of the slit 30 in the second axial direction a2.

The slit adjuster 80 makes the slit 30 have a quadrangular shape, and adjusts the area of the slit 30 by adjusting the length width and breadth width of the slit 30.

Although the size of the slit 30 is adjusted by the slit adjuster 80 to accurately adjust the cross-sectional area of the laser beam B, the laser beam B emitted from the laser beam emitter 20 may be concentrically aligned with the slit 30.

The laser beam B passing through the slit 30, the size of which is adjusted by the pair of first moving plates 81 and the pair of second moving plates 82 has a quadrangular cross-section, but changes to have a circular cross-section while passing a condensing lens 50 (to be described later), thereby reaching the substrate 2 as having the circular cross-section.

When the laser beam B emitted from the laser beam emitter 20 has a diameter of 3 mm, the slit adjuster 80 may adjust the width of the slit 30 in each direction within a range of 0~3 mm.

The first moving plate 81 and the second moving plate 82 may be moved by a motor, a cylinder or the like driving means (not shown).

The first moving plate 81 and the second moving plate 82 may be spaced apart from each other in an emission direction of the laser beam B.

If the first moving plate 81 and the second moving plate 82 are disposed at the same height, it is impossible to make the slit have various sizes because of interference between the moving plates 81 and 82. According to the disclosure, the first moving plate 81 and the second moving plate 82 do not interfere with each other as disposed at different heights and spaced apart from each other, and it is thus possible to variously adjust the widths of the slit 30.

Further, when the first moving plates 81 are spaced apart in the emission direction of the laser beam B and the second moving plates 82 are spaced apart in the emission direction of the laser beam B, in other words, when the moving plates are disposed at different positions in the emission direction of the laser beam B, there is no need to worry about collision between the first moving plates 81 or between the second moving plates 82 even though the slit adjuster 80 makes an error in operation.

The EHD printing apparatus 1 according to the disclosure may further include a check lamp 91 and a check camera 92 in addition to the slit 30.

The check lamp 91 and the check camera 92 are driven before forming the deposition structure on the substrate 2. The check lamp 91 emits check light L to the substrate 2 through the slit 30, and the check camera 92 captures the check light L reaching the substrate 2.

In other words, the check light L travels along the same path as the path of the laser beam B and reaches the substrate 2 while having almost the same state as that of the laser beam B, and the check camera 92 captures the check light L, thereby making it possible to previously and visually check how large the cross-sectional area of the laser beam B is and what position the laser beam B reaches the substrate 2. Based on check results, the size of the slit 30 or the reaching position of the laser beam B is accurately adjusted by the slit adjuster 80.

The check light L does not have high energy unlike the laser beam B, and thus has no influence on the liquid discharged from the nozzle 10 or the substrate 2.

Figure 5:
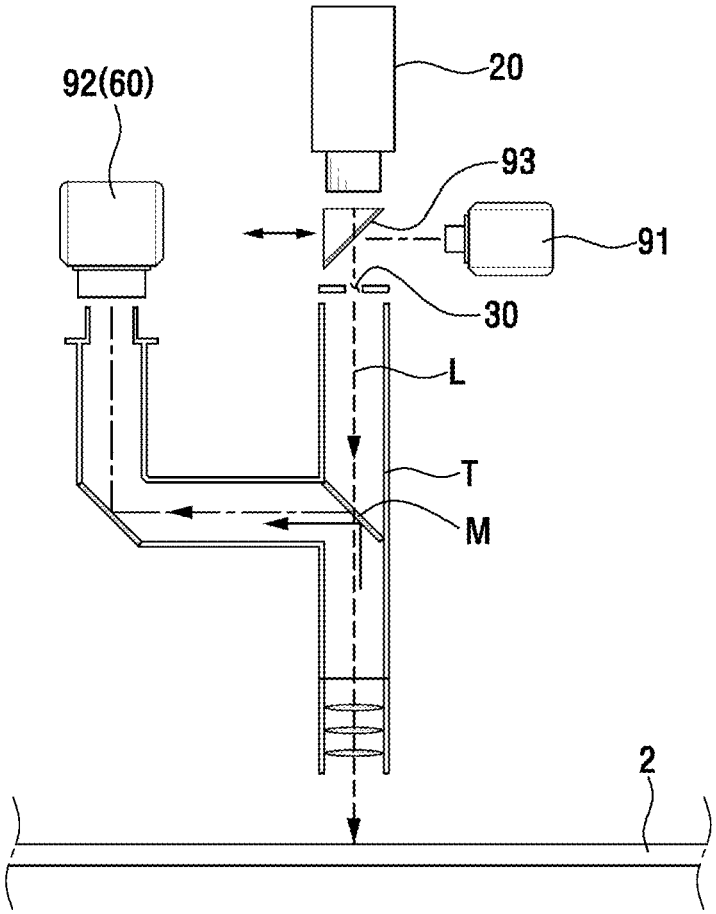
FIG. 5 is a diagram showing a check lamp and a check camera of an electrohydrodynamic printing apparatus according to the disclosure.

The check lamp 91 emits the check light L in a direction perpendicular to the emission direction of the laser beam B as shown in FIG. 5, and a mirror 93 formed obliquely reflects the check light L in the same direction as the laser beam B. The mirror 93 is movable and thus placed not to interfere with the optical path of the laser beam B when the laser beam B is emitted.

The laser beam emitter 20 may emit the laser beams B different in wavelength according to the kind of liquid discharged from the nozzle 10.

Energy needed for hardening the liquid may be varied in intensity depending on the kind of liquid discharged from the nozzle 10, and therefore the laser beam emitter 20 emits the laser beams B different in wavelength from one another according to the kinds of liquid.

The laser beam emitter 20 may for example emit an infrared (IR) ray having a wavelength ranging from 700 nm to 1 mm, visible light (VIS) having a wavelength ranging from 400 nm to 700 nm, an ultraviolet (UV) laser having a frequency of ranging from 180 nm to 400 nm, etc.

Further, a high-power light emitting diode (LED), intense pulsed light (IPL), a xenon source, or the like energy source of outputting high energy may be used.

The laser beam B may be emitted in the form of a continuous laser or a pulse laser.

The continuous laser beam B is continuously emitted with energy of a constant level, and continuously hardens the liquid discharged from the substrate 2.

The pulse laser beam B is intermittently emitted with energy of a constant level, and has high energy density when emitted. Therefore, the pulse laser beam B may be useful when liquid that requires high energy to be hardened is used to form a deposition structure.

When the laser beam B is emitted in the form of the pulse laser, a pulse with which the laser beam B is emitted is synchronized with a frequency at which the nozzle 10 discharges the liquid, so that the laser beam B can be emitted every time when the liquid is discharged.

The EHD printing apparatus 1 according to the disclosure may further include the condensing lens 50.

As shown in FIG. 1, the condensing lens 50 is adjacent to the substrate 2 and serves to condense the laser beam B emitted from the laser beam emitter 20.

The laser beam B is the concentrated light, but may diffuse as it travels farther. Therefore, the laser beam B is condensed by the condensing lens 50 before the laser beam B reaches the substrate 2, thereby applying the laser beam B to only a portion of the liquid needed to be hardened.

The condensing lens 50 may include a plurality of lenses 51 to enhance a condensing degree of the laser beam B.

Further, as described above, the condensing lens 50 may return the cross-section of the laser beam B, which is changed to have the quadrangular cross-section as passed through the slit 30, to the circular cross-section.

The EHD printing apparatus 1 according to the disclosure may further include a first monitoring camera 60.

When a microscale deposition structure is formed on the substrate 2, a yield may be varied depending on a very small error during working or a minor malfunction.

The first monitoring camera 60 monitors in real time a process that the liquid discharged from the nozzle 10 is deposited and hardened on the substrate 2, and it is this possible to immediately cope with an error or the like occurring while forming the deposition structure.

The first monitoring camera 60 may be the same as the check camera 92.

The first monitoring camera 60 may be configured to capture an image viewed on the same line as the laser beam B emitted from the laser beam emitter 20.

If the optical axis of the first monitoring camera 60 deviates from the traveling path of the laser beam B or is formed at an angle to the laser beam B, it is difficult to intuitively check a reaching position of the laser beam B from the image captured by the first monitoring camera 60.

On the other hand, according to an embodiment, the first monitoring camera 60 is configured to capture an image viewed on the same line as the laser beam B, and it is therefore possible to capture an image of the position, to which the laser beam B is emitted, as viewed from directly above, thereby easily and accurately checking the reaching position of the laser beam B and checking whether work of forming the deposition structure proceeds accurately.

Figure 6:
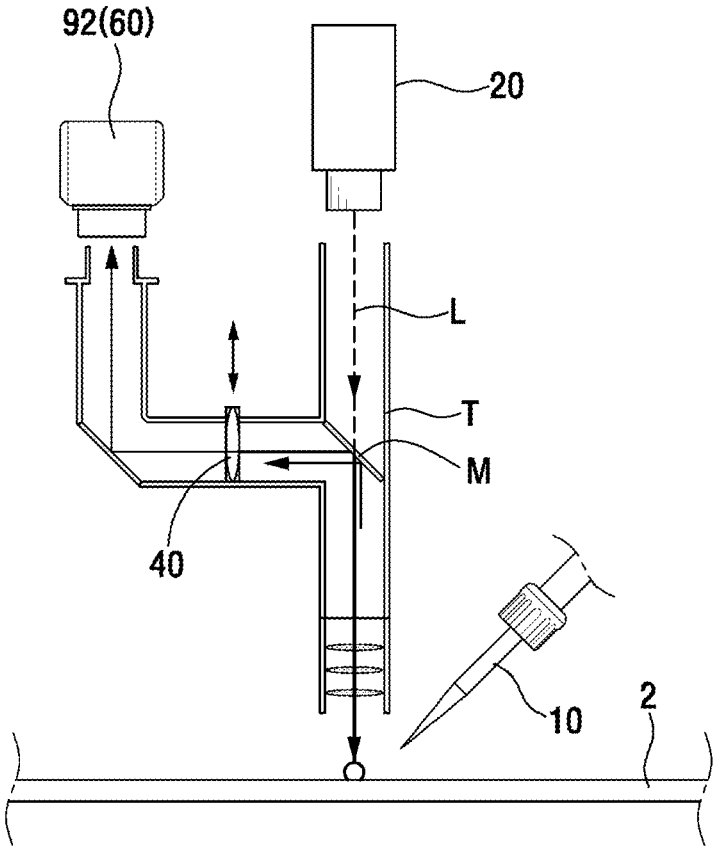
FIG. 6 is a diagram showing a first monitoring camera of an electrohydrodynamic printing apparatus according to the disclosure.

To make the first monitoring camera 60 capture an image viewed on the same line as the laser beam B, for example, as shown in FIG. 6, a half mirror M is obliquely disposed as a beam splitter on the path of the laser beam B. In other words, the half mirror M is treated with a special coating and transmits light of a specific wavelength range, so that the laser beam B of the specific wavelength range can reach the substrate 2 and light of a VIS range can be reflected to send the image at the reaching position of the laser beam B to the first monitoring camera 60 deviating from the optical path of the laser beam B, thereby making the first monitoring camera 60 capture the image viewed on the same line as the laser beam B even though the first monitoring camera 60 is not placed on the optical path of the laser beam B.

The EHD printing apparatus 1 according to the disclosure may include a second monitoring camera 70 in addition to the first monitoring camera 60.

Figure 7:
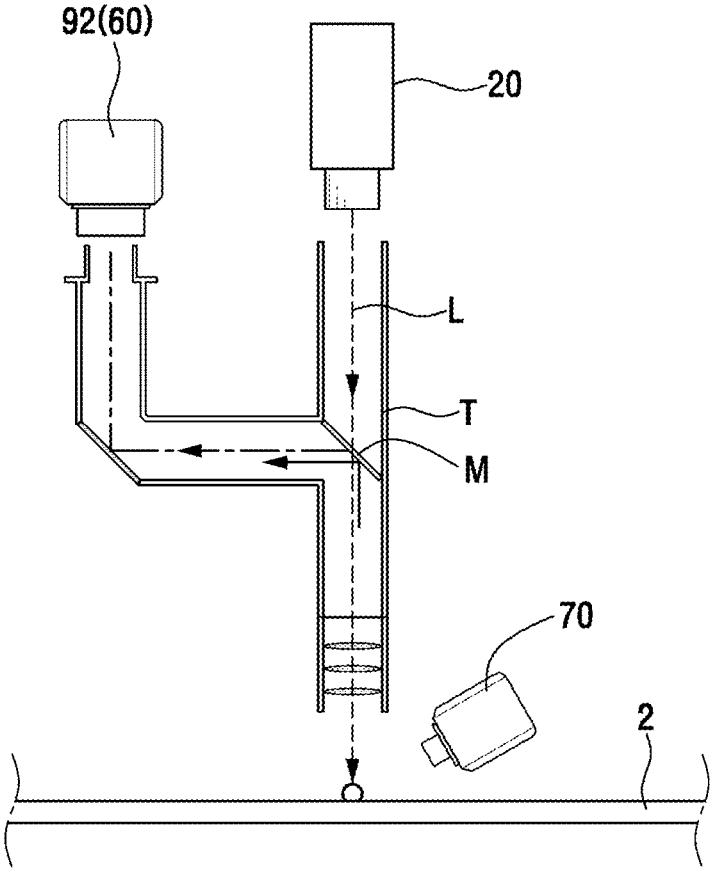
FIG. 7 is a diagram showing a second monitoring camera of an electrohydrodynamic printing apparatus according to the disclosure.

The second monitoring camera 70, as shown in FIG. 7, has an optical axis obliquely formed with regard to the optical axis of the first monitoring camera 60, and captures a larger region than the first monitoring camera 60.

In other words, the second monitoring camera 70 monitors an overall process of forming a deposition structure at a different angle from the first monitoring camera 60, thereby allowing a worker to more accurately monitor the process of forming the deposition structure.

The second monitoring camera 70 may be at angle of 90 degrees to the nozzle 10 with respect to the optical path of the laser beam B in order to avoid interference with the nozzle 10.

On the optical path between the first monitoring camera 60 and the substrate 2, a cut filter 40 may be provided to filter out a part of light.

To capture the process of forming the deposition structure on the substrate 2, the first monitoring camera 60 detects light reflected from the substrate 2 and converts the light into an electric signal. However, energy the reflection light of the laser beam B has is so high that an image capturing device of the first monitoring camera 60 may be damaged and a captured image is too bright to properly monitor the process of forming the deposition structure on the substrate 2 when the reflection light directly reaches the image capturing device of the first monitoring camera 60.

The cut filter 40 inhibits the laser beam B reflected from the substrate 2 from directly reaching the first monitoring camera 60, thereby inhibiting the first monitoring camera 60 from being damaged, and making it possible to accurately identify states of objects from the captured image.

As shown in arrows of FIG. 6, when the cut filter 40 is not in use, the cut filter 40 may move not to interfere with the optical path between the first monitoring camera 60 and the substrate 2.

Of course, the cut filter for filtering out a part of light may be also provided on the optical path between the second monitoring camera 70 and the substrate 2.

The EHD printing apparatus 1 according to the disclosure may further include a nozzle driver (not shown) and a laser-beam emitter driver (not shown).

The nozzle driver serves to move the nozzle 10 in x-axial, y-axial and z-axial directions, and makes the EHD printing apparatus 1 according to the disclosure to form not only a two-dimensional deposition structure but also a three-dimensional deposition structure.

The position of the liquid discharged onto the substrate 2 is changed as the nozzle 10 moves, and therefore the laser beam emitter 20 is also driven to move in the x-axial, y-axial and z-axial directions by the laser-beam emitter driver and hardens the liquid discharged from the nozzle 10.

As described above, the EHD printing apparatus 1 according to the disclosure employs the laser beam B to immediately harden the liquid discharged onto the substrate 2 so that the discharged liquid can be positioned on the substrate while having a stable state. Therefore, the deposition structure is generally maintained in a stable state even though the liquid is discharged onto a part of the previously formed deposition structure, and it is thus possible to accurately form a three-dimensional deposition structure.

Besides the foregoing elements, the EHD printing apparatus according to the disclosure may further include a controller for controlling the nozzle, the voltage applier, the laser beam emitter, etc. and a display for displaying an image captured by the first monitoring camera or the like.

With an EHD printing apparatus of the disclosure, liquid discharged onto substrate is immediately hardened by the laser beam, and it is thus possible to form a deposition structure of a stable state.

Such features are in particular effective for forming a microscale deposition structure with which accuracy is important.

Further, the laser beam is exactly emitted to only the liquid discharged onto the substrate, and thus has less influence on the other portion of the substrate.

When the EHD printing apparatus according to the disclosure further includes the slit, the slit adjuster and the condensing lens, it is possible to more accurately emit the laser beam. When the EHD printing apparatus according to the disclosure further includes the camera, it is possible to accurately monitor a working process in real time.

Further, the EHD printing apparatus according to the disclosure can accurately and stably form a three-dimensional deposition structure.

Although a few exemplary embodiments of the present disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An electrohydrodynamic printing apparatus comprising:

a nozzle configured to discharge liquid toward a substrate;

a voltage applier configured to form an electric field between the nozzle and the substrate; and a laser beam emitter configured to emit a laser beam toward a position to which liquid is discharged on the substrate.

2. The electrohydrodynamic printing apparatus according to claim 1, wherein the laser beam emitter is configured to emit the laser beam in a direction perpendicular to the substrate.

3. The electrohydrodynamic printing apparatus according to claim 2, wherein the nozzle is provided obliquely to the substrate.

4. The electrohydrodynamic printing apparatus according to claim 1, further comprising a slit through which the laser beam passes.

5. The electrohydrodynamic printing apparatus according to claim 4, further comprising a slit adjuster configured to adjust a size of the slit.

6. The electrohydrodynamic printing apparatus according to claim 5, wherein the slit adjuster comprises:

a pair of first moving plates configured to move in a first axial direction perpendicular to the laser beam and adjust a spaced distance therebetween to adjust a width of the slit in the first axial direction; and a pair of second moving plates configured to move in a second axial direction perpendicular to the laser beam and the first axial direction and adjust a spaced distance therebetween to adjust a width of the slit in the second axial direction.

7. The electrohydrodynamic printing apparatus according to claim 6, wherein the first moving plate and the second moving plate are disposed as spaced apart in an emission direction of the laser beam.

8. The electrohydrodynamic printing apparatus according to claim 4, further comprising:

a check lamp configured to emit check light to pass through the slit and reach the substrate; and a check camera configured to capture the check light that reaches the substrate.

9. The electrohydrodynamic printing apparatus according to claim 1, wherein the laser beam emitter emits laser beams different in wavelength according to kinds of liquid discharged from the nozzle.

10. The electrohydrodynamic printing apparatus according to claim 1, wherein the laser beam is emitted as a continuous laser.

11. The electrohydrodynamic printing apparatus according to claim 1, wherein the laser beam is emitted as a pulse laser.

12. The electrohydrodynamic printing apparatus according to claim 11, wherein a pulse with which the laser beam is emitted is synchronized with a frequency at which the nozzle discharges the liquid.

13. The electrohydrodynamic printing apparatus according to claim 1, further comprising a condensing lens adjacent to the substrate and configured to condense the laser beam.

14. The electrohydrodynamic printing apparatus according to claim 1, further comprising a first monitoring camera configured to monitor in real time a process of depositing and hardening the liquid discharged from the nozzle onto the substrate.

15. The electrohydrodynamic printing apparatus according to claim 14, wherein the first monitoring camera is configured to capture an image viewed on the same line as the laser beam.

16. The electrohydrodynamic printing apparatus according to claim 14, further comprising a cut filter disposed on an optical path between the first monitoring camera and the substrate and configured to filter out a part of light.

17. The electrohydrodynamic printing apparatus according to claim 14, further comprising a second monitoring camera comprising an optical axis formed obliquely to an optical axis of the first monitoring camera, and configured to capture a larger region than the first monitoring camera.

18. The electrohydrodynamic printing apparatus according to claim 1, further comprising:

a nozzle driver configured to move the nozzle in x-axial, y-axial and z-axial directions; and a laser-beam emitter driver configured to move the laser beam emitter in the x-axial, y-axial and z-axial directions.

* * * * *